United States Patent [19]

Brandt et al.

[11] Patent Number: 4,501,560

[45] Date of Patent: Feb. 26, 1985

[54] INBOARD OUTBOARD DRIVE

[75] Inventors: Lennart Brandt, Fjäras; Heinz Pichl, Upsala, both of Sweden

[73] Assignee: AB Volvo Penta, Goteborg, Sweden

[21] Appl. No.: 461,877

[22] Filed: Jan. 28, 1983

[30] Foreign Application Priority Data

Feb. 3, 1982 [SE] Sweden ..... 8200600
Feb. 3, 1982 [SE] Sweden ..... 8200601
Feb. 3, 1982 [SE] Sweden ..... 8200602

[51] Int. Cl.[3] ..... B63H 5/12
[52] U.S. Cl. ..... 440/53; 440/73
[58] Field of Search ..... 440/52-65, 440/73, 75, 111, 112; 308/218; 192/84 C, 89 B

[56] References Cited

U.S. PATENT DOCUMENTS 2,976,836 3/1961 Fageol ..... 440/112
3,010,422 11/1961 Brakensiek ..... 440/88
3,529,564 9/1970 Osswald et al. ..... 440/112
4,354,846 10/1982 Eighinger ..... 440/52

*Primary Examiner*—Trygve M. Blix
*Assistant Examiner*—Jesûs D. Sotelo
*Attorney, Agent, or Firm*—Arthur G. Yeager

[57] ABSTRACT

An inboard outboard drive for boats, particularly planing boats, of the S-type comprising an inboard engine and a vertical propeller leg having an upper inboard end and extending through an opening in the hull to an outboard propeller carrying portion. The engine has a horizontal output shaft with a universal joint driving shafting extending through the propeller leg to drive the propeller. The propeller leg for side steering is pivotally mounted in a watertight bearing which is located inboard and is inclined so that the bearing axis, defining the side steering axis, passes through the universal joint. The drive is supported near its forward end on two vibration damping supports mounted in the hull and supporting the engine, and on a resilient damping member mounted in the hull and supporting the projecting portion of a bracket which supports the propeller leg to reduce the lever arm of the propeller thrust. The propeller leg is assembled from an inboard module and an outboard module each having power transmission shafting and having attachment member for securing the modules together and sealing the opening in the hull.

28 Claims, 25 Drawing Figures

INBOARD OUTBOARD DRIVE

RELATED APPLICATIONS

This application is related to the following applications entitled: INBOARD OUTBOARD DRIVE AND MOUNTING SHIELD THEREFOR; U.S. Ser. No. 461,876 and INBOARD OUTBOARD DRIVE AND MOUNTING THEREFOR U.S. Ser. No. 461,962 both filed on Jan. 28,1983.

FIELD OF INVENTION

This invention relates to inboard outboard drives of the type where the propeller leg extends through an opening in the bottom of the hull of the boat, and particularly to an improved mounting of the propeller leg for side steering and stress relieving and vibration damping purposes, and to an improved modular housing arrangement of the propeller leg assembly.

DESCRIPTION OF THE PRIOR ART

Inboard outboard drives as shown in FIG. 1 are known in the prior art having an engine part with an output shaft located inboard and a propeller leg or lower unit which has an inboard located upper end portion for attachment to the engine part adjacent the output shaft, an intermediate portion extending vertically downwardly via an opening in the bottom of the hull surface of a boat, and an outboard propeller portion at the lower end on which a propeller is mounted. The horizontal output shaft is by an upper angular gear box in the upper portion, a vertical power transmission shaft in the intermediate portion, a lower angular gear box and a horizontal propeller shaft drive-connected to the propeller on the propeller portion. The propeller leg assembly includes thus shafting and a lower angular gear box in the propeller housing portion for the transmission of torque from the engine part to a propeller mounted on the propeller housing.

The large propeller thrust and the long lever arm between the propeller shaft and engine output shaft produce a large bending moment, e.g. in the order of 300 to 500 kilopounds, causing stress at the connection of the propeller leg to the engine part, which connection is located in the region where the horizontally extending engine output shaft projects from the engine part. The propeller leg, where it extends through the opening in the hull, does not engage the hull in a rigid manner, because vibration causing noise and stress would be transferred to and magnified by the hull. Thus the propeller leg does not positively or rigidly engage the hull to provide a reaction for the propeller thrust bending moment.

Inboard outboard drives of this type, where the propeller leg extends through an opening in the bottom of the boat hull, have been used as auxiliary motors for sailing boats and are therefore often called S-drives. Although an S-drive generally includes an upper angular gear box between the horizontal output shaft of the engine part and the transmission shaft in the propeller leg assembly, the output shaft of the engine part may also be aligned with this transmission shaft, e.g. by the engine extending vertically, and then an upper angular gear box is not needed.

Other inboard outboard drives where the propeller leg is mounted on the transom and located completely outboard are called Z-drives and may be pivoted for side steering. In S-drives the propeller leg has been in general non-pivotally attached to other parts of the drive and side steering of the boat has been effected by a rudder blade of that boat in the same manner as in sailing boats without a motor and in motor boats with an inboard motor. This type of steering a boat driven by an S-drive often provides poor maneuverability at low velocities because the flow forces on the rudder blade are small.

SUMMARY OF THE INVENTION

An object of the present invention is to provide an improved inboard outboard drive of the S-type described above including a propeller leg extending through an opening in the bottom of the hull of a boat and having an outboard propeller housing portion which is pivotally mounted for side steering. Such a driving system provides proper maneuvering power because the transverse force for side steering is then a component of the thrust of the propeller.

The propeller leg comprises an upper inboard portion, an intermediate portion at said opening in the hull and an outboard propeller mounting portion. The propeller leg has power shaft means having an inboard upper angular gear box and an outboard lower angular gear box connected by power transmission shafting. The power transmission shafting between the engine and the upper angular gear box includes a universal joint. The propeller leg assembly is pivotally mounted by bearing means on the boat hull or on a bracket fixedly attached to the engine part for pivotal movement about the bearing axis or side steering axis which passes through the universal joint and the upper part of which is inclined forward relative to the power transmission shafting extending in the propeller leg between the upper and lower angular gear boxes. This forward inclination of the upper part of the steering axis improves appreciably the steering qualities of the boat, and in particular reduces the necessary steering effort in comparison to all hitherto known motor-driven sailing boats. The lower angular gear box, generally a 90° gear box, can drive either a single propeller or a dual propeller assembly.

A cooling water system has an inlet or orifice opening located at the forward end of an outboard portion of the propeller leg and connected to a cooling water pipe mounted concentrically with the inclined steering axis to draw cooling water for the engine. The inlet has a self cleaning anticlogging device employing a grill and a cleaning comb on the hull having relative movement in response to steering movement. The lower outboard or propeller housing portion of the propeller leg may be made symmetrical for attachment in two rotational positions, one for driving at least one pusher propeller and the other for driving at least one traction propeller.

Another object of the present invention is to provide an inboard outboard drive construction and arrangement for mounting in the hull of a boat to reduce said stress and to obtain a lower level of vibration and noise transmitted to the hull and thus a quieter hull.

The inboard outboard drive has, as already stated, an engine part with a horizontal output shaft, a propeller leg with an upper portion with an upper gear aligned with and driven by the engine output shaft, an intermediate portion extending through an opening in the hull and an outboard propeller portion with a lower gear box driven by a vertical shaft connected to the upper gear box and driving a horizontal propeller shaft and propeller. The engine part is supported at a lower portion, near one end of the engine part, by first resilient vibration damping means. The output shaft projects from the other end of the engine. A mounting bracket is fixed on the engine part and also projects from the other end of the engine part below the output shaft. The propeller leg is mounted by the bracket on the engine part so that the engine part and the propulsion leg or system function as a single, large mass of inertia so that rather hard and effective vibration dampers or insulators may be used. The propeller leg is mounted on the bracket in a place located below the upper gear box and spaced below the output shaft. The mounting bracket is supported, particularly at its free end, by second resilient vibration damping means.

A further object of the invention is to provide an improved inboard outboard drive of the type described above wherein the propeller housing portion and/or the upper portion of the propeller leg assembly may readily be dismantled for repair or modification purposes without the boat becoming unable to float on that account, and in the case of the upper portion of the propeller leg assembly, even without the need to take the boat out of the water.

The propeller leg assembly or lower unit is constructed according to module construction principles so a further advantage is obtained, viz. that different drives may readily be assembled from several basic components. In particular a preferred embodiment with an intermediate module permits many variations in the construction of the drive, without the need to make any structural changes on the hull and/or on the engine part. The invention permits the alternate use of spare part modules, and makes it further possible to produce larger series of certain basic components, e.g. the inboard module. Engine parts of different types can be easily adapted to fit the module-constructed propeller leg part or lower unit.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

Figure 1:
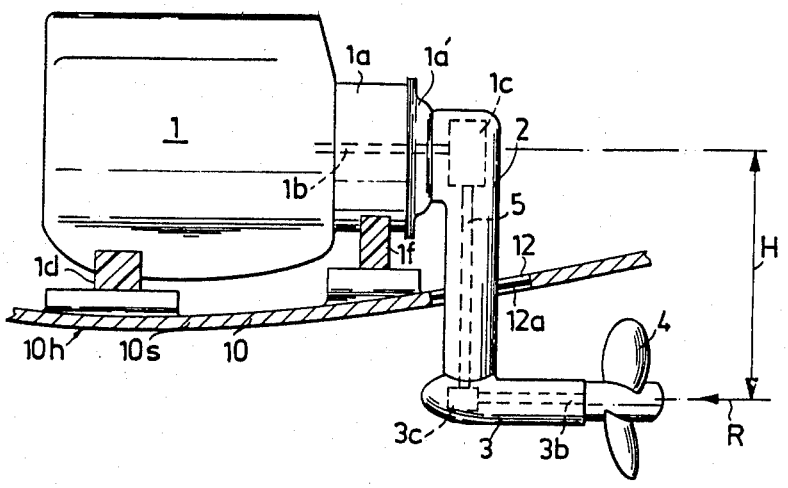
Fig. 1 PRIOR ART.
FIG. 1 is a schematic side view with parts in section of a prior art S-drive relating to the invention shown in FIGS. 2 to 25.

Structural parts having basically the same function are in all the drawing figures designed by identical or analogous reference numerals and reference is made to the description of other figures.

DESCRIPTION OF THE PREFERRED EMBODIMENTS

According to FIG. 1, which shows related prior art, an inboard outboard drive of the so-called S-type has an engine part 1 with a flywheel housing 1*a* which is terminated by a cap 1*a'* to which the upper end of a propeller leg assembly or lower unit is attached, e.g. riveted. The output shaft 1*b* of engine part 1 enters propeller leg assembly 2 and is connected to upper angular gear box 1*c* to drive power transmission shaft 5 in propeller leg 2. At the bottom or lower end of propeller leg 2 is a propeller housing portion 3 having therein a lower angular gear box 3*c* drive-connecting power transmission shaft 5 to propeller shaft 3*c* which extends through propeller housing 3 and on which propeller 4 is mounted. Propeller leg 2 passes through an opening 12 in the bottom 10 of the shell 10*s* of hull 10*h*. Opening 12 is somewhat larger than the outer circumference of propeller leg 2 and the intermediate space between propeller leg 2 and bottom 10 is sealed by a resilient sealing membrane 12*a*. The propeller leg 2 provides a watertight enclosure which is sealed to the bottom 10 by membrane 12*a* to provide a watertight hull 10*h* with an inboard outboard drive.

The engine 1 rests on three damper blocks of resilient material, of which the forward ones or pair 1*d* (only one can be seen in the drawings) lie side by side or are spaced transversely, and the third one, 1*f*, centrally supports the flywheel housing 1*a*. The thrust of the propeller acts horizontally forward in the sense of arrow R and has a lever arm H causing a bending moment which acts on the engine part 1 at the cap 1*a'* of the flywheel housing 1*a*, in the region where the output shaft 1*b* protrudes or extends.

Engine part 1 is horizontally mounted on a resilient vibration absorbing support means, provided by rubber blocks 1*d*, inboard to bottom shell 10*s* of boat hull 10*h* and has horizontal output shaft 1*b* extending from flywheel housing 1*a*.

Figure 2:
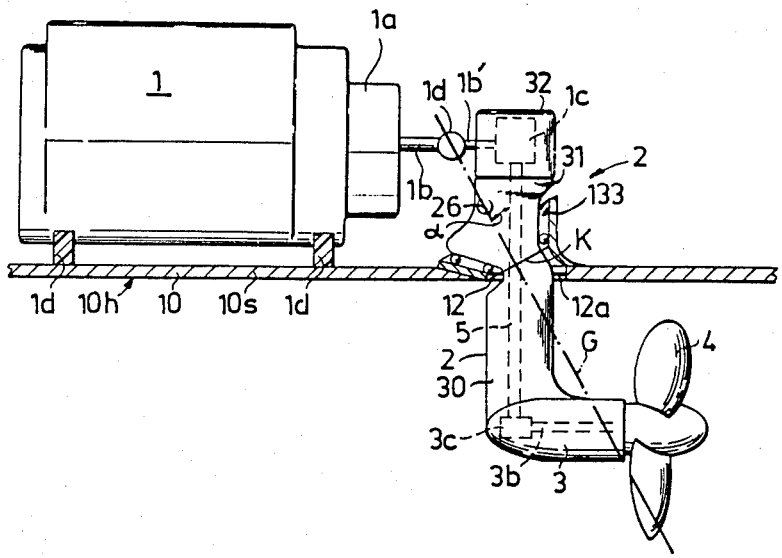
FIG. 2 is a schematic side view with parts in section of a first embodiment of a steering inboard outboard drive according to the invention.

According to the present invention, as illustrated in FIG. 2, the propeller leg (lower unit) 2 is in the exemplified embodiment an assembly of modules, and is pivotally mounted by a pivotal bearing 133 which is secured and mounted in an inclined position on the bottom shell 10*s* of boat hull 10*h*. Propeller leg 2 has at its lower end a propeller housing portion 3 having therein a 90° lower angular gear box connected to drive a pusher propeller 4 rotatably mounted thereon. A power transmission shaft 5 extends vertically inside propeller leg 2 to provide a drive connection between upper angular gear box 1*c* and lower angular gear box 3*c*. Propeller shaft 3*b* on which propeller 4 is mounted is driven by lower angular gear box 3*c* wherefrom it extends. These gear boxes and shafts provide power transmission means mounted in propeller leg 2 for drive-connecting engine 1 to drive propeller 4. The propeller leg 2 passes or extends through opening 12 in bottom shell 10*s*. Opening 12 is larger than the outer circumference of propeller leg 2 and is sealed by a membrane 12*a* to prevent the entry of water in which the boat floats into the hull 10*h*.

A side-steering device or actuator, not shown, e.g. a steering cable, is attached to one or two oppositely disposed steering arms 26 which are attached to and project from the side of propeller leg 2. The side steering device is operated from the drivers's place to rotate or pivot propeller leg 2 in one or the other sense about the steering axis G.

A universal joint 1*d* is arranged inboard between output shaft 1*b* and stub shaft 1*b'*, i.e. between engine part 1 and the housing or upper module unit 32 in which upper gear box 1*c* is located. The pivotal bearing 133 is inclined relative to power transmission shaft 5 with such an angle $\alpha$ that the steering axis G passes through universal joint 1*d*.

Propeller leg 2 comprises three portions, more precisely, in the exemplary embodiment shown, three module units, viz. an upper gear box housing or upper inboard module 32, an intermediate housing or module unit 31 and a lower outboard underwater housing or module unit 30 which comprises propeller housing portion 3. The intermediate module 31 is attached to upper module 32 and lower module 30 is firmly attached at K to intermediate module 31 to form a watertight propeller leg assembly 2. Intermediate unit 31 has a convex conic envelope surface providing an upper bearing surface fitting into a lower concave conic surface in pivotal bearing 133 to pivotally mount propeller leg 2 on hull 10*h* for pivotal movement about the bearing axis which coincides with steering axis G. The conic bearing surfaces have the smaller diameter portions at the lower end, so that pivotal bearing 133 supports propeller leg 2 and the propeller leg 2 can be inserted from above into pivotal bearing 133 and opening 12. It will be appreciated that the convex conic surface also may be, with appropriate inclination, provided on or attached to e.g. a cylindrical propeller leg which in such a case may be manufactured in one piece, and from above inserted into the concave conic surface of the bearing. An attachable part with a convex conic surface is shown in FIGS. 5 and 6.

Figure 3:
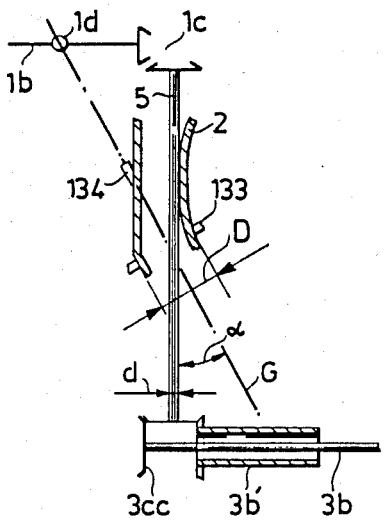
FIG. 3 is a diagramatic view showing the relation between the steering axis and the power transmission axis.
Figure 10:
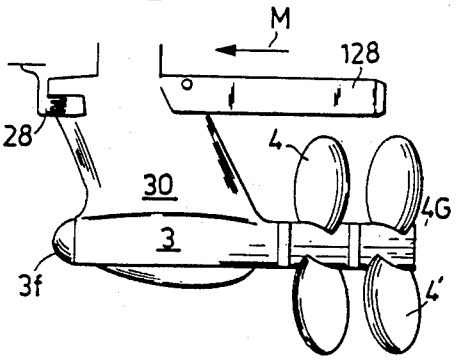
FIG. 10 is a partial side view of the mounting of a dual pusher propeller unit.

FIG. 3 is a schematic diagramatic view of an S-drive arrangement with dual propeller shafts 3*b*, 3*b'* for a dual propeller assembly 4, 4' as shown in FIG. 10. The lower angular gear box 3*cc* is arranged for driving propeller shafts 3*b*, 3*b'* in opposite directions. The propeller leg 2 is mounted in the inclined bearing 133. The least possible inclination (angle $\alpha$) between axis G and shaft 5 is defined by the structural requirements for strength which determine the diameter D of the lower end of intermediate portion 31, which diameter in its turn depends on the wall thickness of the housing material and the diamter d of power transmission shaft 5.

Figure 4:
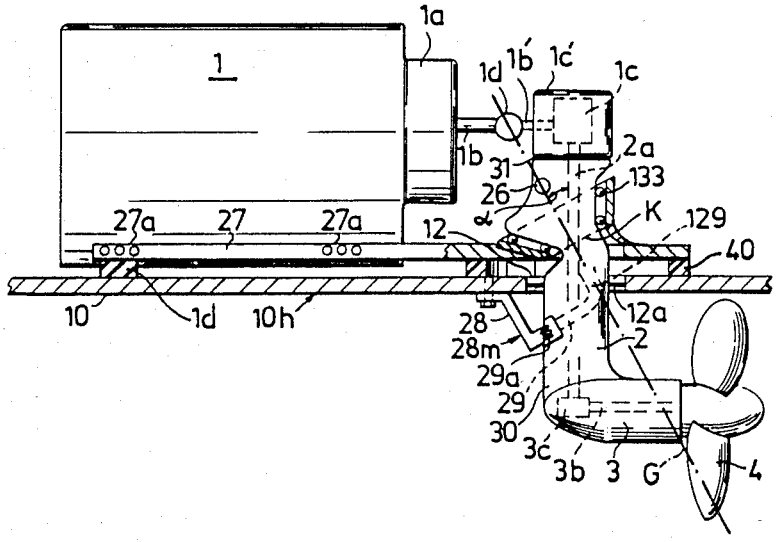
FIG. 4 is a schematic side view with parts in section of a second embodiment.

According to FIG. 4 a straight console or bracket 27 is rigidly attached to engine part 1, e.g. by riveting 27*a*, and the pivotal bearing 133 is mounted on bracket 27. The opening 12 in the bottom 10 of hull 10*h* is sealed by the membrane 12*a* which is sealed to hull 10*h* and around propeller leg 2 and is inboard surrounded by an annular resilient means 40 which supports and possibly also seals the rear terminal portion of bracket 27 where the bearing 133 for the propeller leg 2 is mounted and by which also the rear portion of the engine part 1 is supported, because the rear rubber block 1*d* (FIG. 1) is omitted. Annular means 40 is therefore constantly compressed by a part of the weight of engine part 1 and the whole weight of propeller leg 2 (minus buoyancy of its immersed portion).

Figure 5:
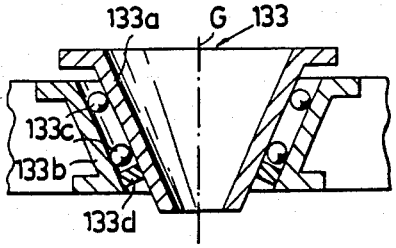
FIG. 5 is an enlarged axial cross sectional view of a modification of the bearing means 133 of FIGS. 2 and 4.
Figure 6:
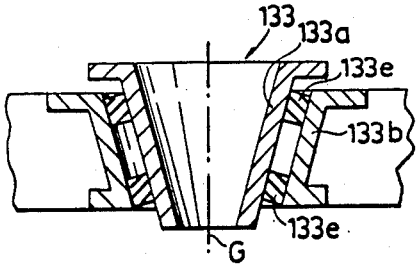
FIG. 6 is an enlarged axial cross sectional view of another modification of bearing means 133.

According to FIGS. 5 and 6, in both embodiments, the pivotal bearing 133 comprises a conic or funnel shaped receiving portion 133*a* for propeller leg 2. Receiver portion 133*a* is pivotally mounted in bearings on a conic bearing bed 133*b* which is mounted with the necessary inclination in hull 10*h* of the boat. FIG. 5 shows the steering axis G and the pivotal bearing 133 having rolling elements such as ball-bearings balls 133*c*, complemented by a sealing packing 133*d*. The FIG. 6 embodiment of bearing 133 has self-sealing slide or surface bearing means 133*e*.

The construction FIG. 4 in which the propeller leg 2 pivotally protrudes from bottom 10 of the hull, permits a special arrangement of the cooling water inlet and enables to provide an automatic cleaning means 28*m* having comb 28 and grill 29*a* for the orifice opening 29 of a cooling water pipe 129. Said cleaning means 28*m* is shown in greater detail in FIGS. 7 and 11. According to FIG. 7 an inlet or orifice portion 29 of a cooling water intake pipe 129 (FIGS. 4 and 8) is provided in the outboard module 30. The water inlet port or orifice opening 29 itself is covered by a grill 29*a* which has transversal slots 29*a'* and which is detachably fixed on outboard module 30 with the aid of mounting screws 229. A cleaning comb 28 has mounting means for mounting outside on the bottom 10 of the hull, or on another non pivotal part on hull 10*h*. Cleaning comb 28 has comb teeth 28' which fit into the slots 29*a* of the grill. The comb teeth 28' scrape clean the slots 29*a'* upon each side-steering movement of propeller leg 2, whereby clogging of the cooling water inlet or orifice opening 29 by deposition of water plants, trash, etc. is hindered or prevented. It will be readily appreciated that the described automatic cleaning means may be equally well applied with the embodiment of FIG. 2.

Figure 8:
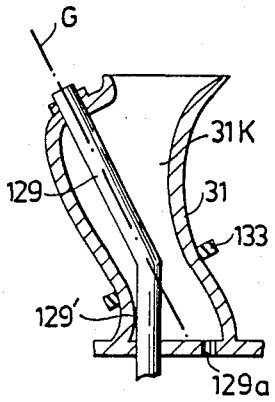
FIG. 8 is a reduced axial cross sectional view of a cooperating intermediate portion of the lower unit.

FIG. 8 shows in a cross-section on a smaller scale through an intermediate module 31, an embodiment of the cooling water intake pipe 129 that has a bend so the upper portion of the pipe may extend concentrically with the steering axis G while in the lower portion 129, this concentric relation does not exist. It will be recognized that the cooling water intake pipe 129 at the same time cools lubricating oil in a space 31K inside the intermediate module 31, where the oil is fed-in through a channel 129*a* between the outboard module 30 (FIGS. 2, 4 or 7) and the intermediate module 31.

Figure 7:
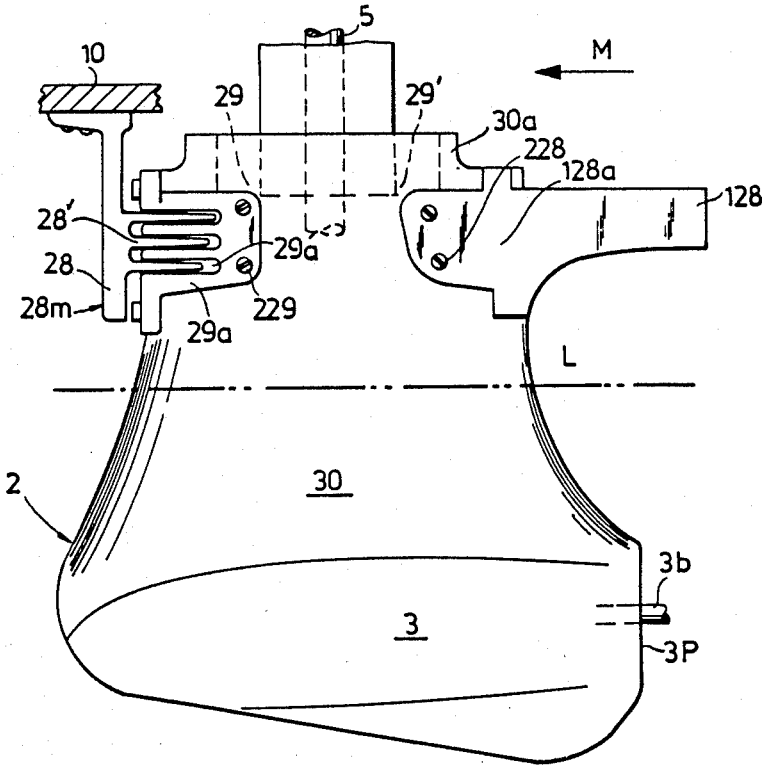
FIG. 7 is a partial side view of a preferred embodiment of a outboard propeller portion of the lower unit with the propeller omitted.
Figure 9:
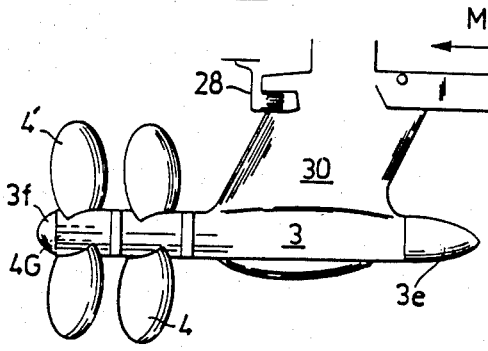
FIG. 9 is a partial side view of the mounting of a dual traction propeller unit.

The outboard module 30 is, in its attachment portion to the inboard module 31, i.e. in the uppermost portion, e.g. above the plane L in FIG. 7, preferably symmetrically shaped so that it may be mounted for pusher propellers FIG. 10 or traction propellers FIG. 9, as desired or needed. Outboard module 30 may then with the aid of a flange 30A be connected to the intermediate module 31 either in the position with attachment portion 3P and propeller shaft 3*b* facing aft at the aft edge as shown in the drawing, or mirror-inverted, i.e. with the attachment portion 3P and propeller shaft 3*b* for propeller 4 turned in the opposite direction facing fore at the fore edge. The inlet portion of the cooling water intake pipe is then doubled to provide 2 inlet portions, with one inlet portion 29 in a left position, and another inlet portion 29' in a right position.

A stabilizing fin (lateral face) 128, known per se, is preferably provided and in such a manner that its attachment portion 128*a* to the propeller leg 2 has the shape of a closing cap for the one of the water pipe inlet or orifice portions 29, 29' which is not in use, i.e. essentially is imperforate, has the same shape as the grill, and is provided with identically located fixing means like grill 29*a*, such as mounting screws 228. Thus when the outboard module 30 is mounted in reverse position, grill 29*a* and fin 128 readily may change place one with another, so that the grill again is located fore and the fin aft in regard to the driving direction, arrow M (FIGS. 7, 9 and 10).

FIGS. 9 and 10 respectively show a traction drive and a pusher drive dual propeller assembly. The propeller housing portion 3 of propeller leg or lower unit 2 is for hydrodynamic reasons complemented with differently shaped closing caps 3*e*, 3*f* depending on whether a closing cap is needed in fore position or in aft position. Cap 3*f* may preferably be shaped so as to also be able to close an exhaust gas discharge portion 4G in the hub of the propeller, as shown in FIG. 9.

Figure 11:
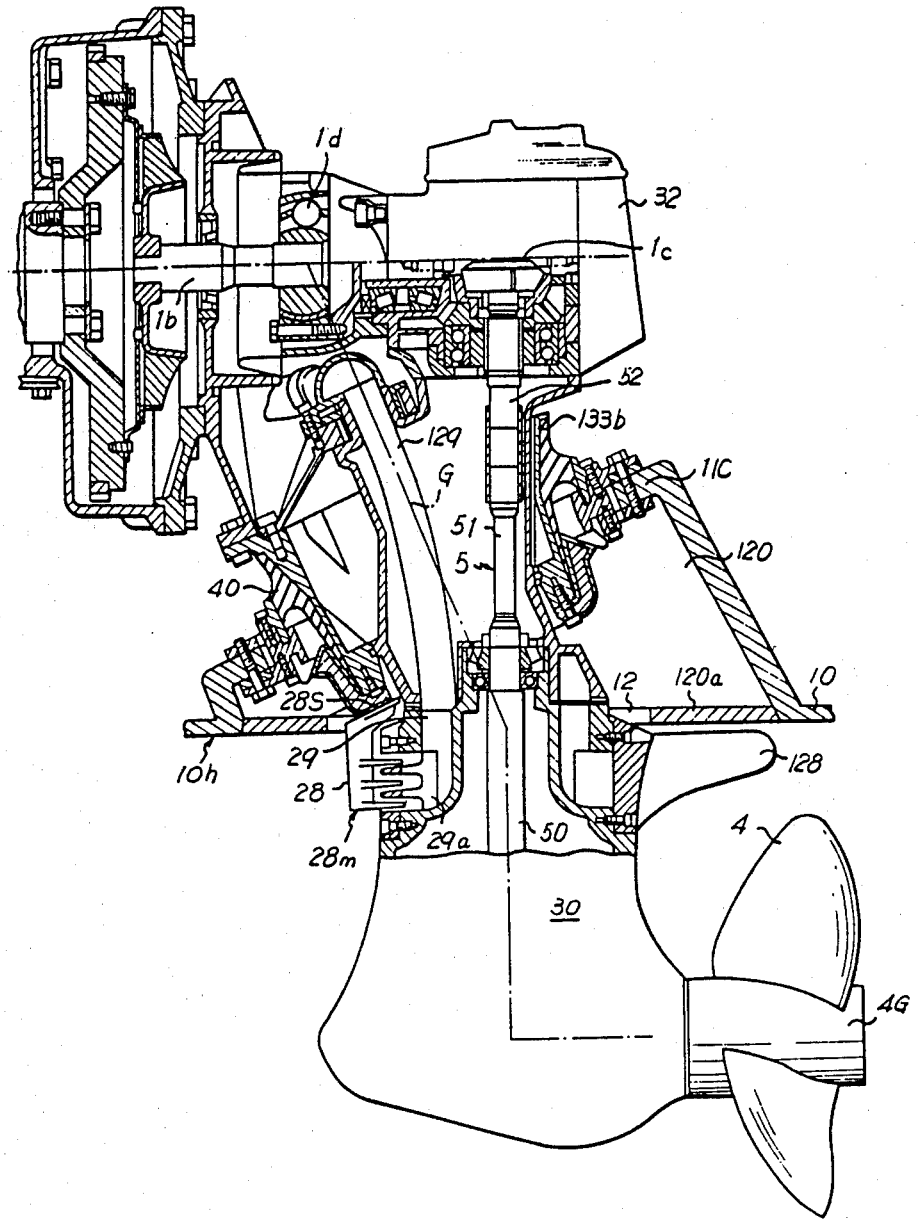
FIG. 11 is a partial side view with parts in section of an S-drive according to the invention.

FIG. 11 shows an S-drive according to the invention mounted on an inclined bed 11C provided in the bottom 10 of the hull 10*h*. The cleaning comb 28 passes through opening 12 in bottom 10 and is attached to a stationary (not rotary or side-steerable) part 28S.

The power transmission means connecting engine part 1 (FIG. 2) to propeller 4 includes a vertically extending power transmission shaft divided into three parts, lower part 50, intermediate part 51 and upper part 52 connected one with another by spline connections when the module units 30, 31 and 32 are assembled forming propeller leg 2.

Between the inclined bed 11C and the bearing bed 133*b* a resilient means 40 is provided having the same sealing and damping functions as resilient means 40 in FIG. 4. The opening 12 is otherwise not particularly sealed, and the space 120 is filled with water, fairing member 120*a* providing principally a hydrodynamic fairing function, without sealing. Other parts are similar to the above described FIGS. 2 to 10.

The steering means 26, FIG. 2, on pivotal propeller leg 2 may, if desired, be mechanically connected to a conventional rudder blade (not shown) of the boat for common rotation in a selected transmission ratio.

The side steering inboard outboard drive according to this invention is, as already stated, advantageous for sailing boats. It is, however, also particularly suited for planing boats (hydroplanes), because such boats slide a little transversely off course when driving along a curved course, and a drive unit with a deflected rudder blade may make it difficult to drive in a curved course, in contrast to a drive with a pivotal propeller housing according to the present invention which makes it easier to drive a curved course.

Figure 12:
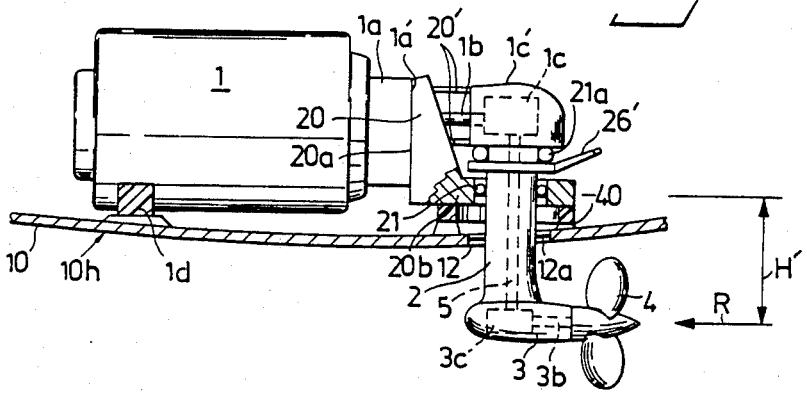
FIG. 12 is a schematic side view with parts in section of an embodiment with a support bracket.

According to FIG. 12, in a modification of the embodiment of FIG. 4, a supporting console or bracket 20 is an angular type bracket and has a vertical leg 20*a* fixed to the flywheel housing 1*a* and a horizontal leg 20*b* for supporting the propeller leg 2. The propeller leg is rigidly but pivotally mounted in rotary bearing 21 in horizontal leg 20*b* of bracket 20 so the propeller leg 2 and engine part 1 act as a unitary inertial mass with regard to stress and vibration. In order to further aid in fixing propeller leg 2 to engine part 1, the upper end of propeller leg 2 also axially engages an axial bearing portion 21*a* of bearing 21 on housing 1*c'* for upper angular gear box 1*c*. The housing 1*c'* is firmly connected by rods 20' to bracket 20 and thus fixed on engine part 1. The upper angular gear box 1*c* is aligned with and driven by horizontal engine output shaft 1*b*. Upper gear box 1*c* drives vertical power transmission shaft 5 extending vertically downwardly in propeller leg 2 to lower angular gear box 3*c* which drives horizontal propeller shaft 3*b* and propeller 4 mounted on propeller housing portion 3 of propeller leg 2. The upper gear box 1*c* and output shaft 1*b* are located a spaced distance above the place of attachment of propeller leg 2 to mounting bracket 20. The bending moment is transferred from propeller leg 2 to engine part 1 at this place of attachment, whereby the engine part is relieved in the region, cap 1*a'* of housing 1*a*, where output shaft 1*b* extends out of engine part 1. The propeller leg 2 is connected to a rudder lever 26' or other side steering device to pivot propeller leg 2 to one side or the other about the vertical axis of bearing 21 for side steering. In this embodiment, the steering axis coincides with the power transmission shaft 5.

The engine part 1 rests at or near its forward portion in a conventional manner on two side by side located or laterally spaced vibration dampening blocks 1*d* of which only one is seen in the FIG. 12 side view. Supporting bracket 20 rests at its free end on a resilient vibration damping annular element 40 which surrounds opening 12 and propeller leg 2. The whole inboard outboard drive, i.e. engine part 1, propeller leg 2 and housing 1*c'* provide a unitary mass of inertia resting at the forward end of engine part 1 and at the rear or propeller leg end on vibration damping means mounted in hull 10*h*. A thin sealing membrane 12*a* is provided in the opening 12 and sealed to hull 10*h* and around propeller leg 2. The bearing 21 may also be sealed and then annular element 40 would also seal opening 12.

According to FIG. 13 a straight support bracket 27 has a pair of arms 27*a* one on each side of engine part 1, each secured, e.g. by rivets 27', to the front and rear of the lower portion of engine part 1, and a base or platform 27*b* at the rear of the engine part below engine output shaft 1*b*. The propeller leg 2 extends through hole 27*c* in base 27*b* and is secured and sealed thereto by bolts 2*b*. The resilient annular element 40 between bracket base 27*b* and hull 10*h* provides sealing, so a separate sealing membrane may, if desired, be omitted. The drive means between the horizontal engine output shaft 1*b* and horizontal propeller shaft 3*b* is the same as described above.

Figure 14:
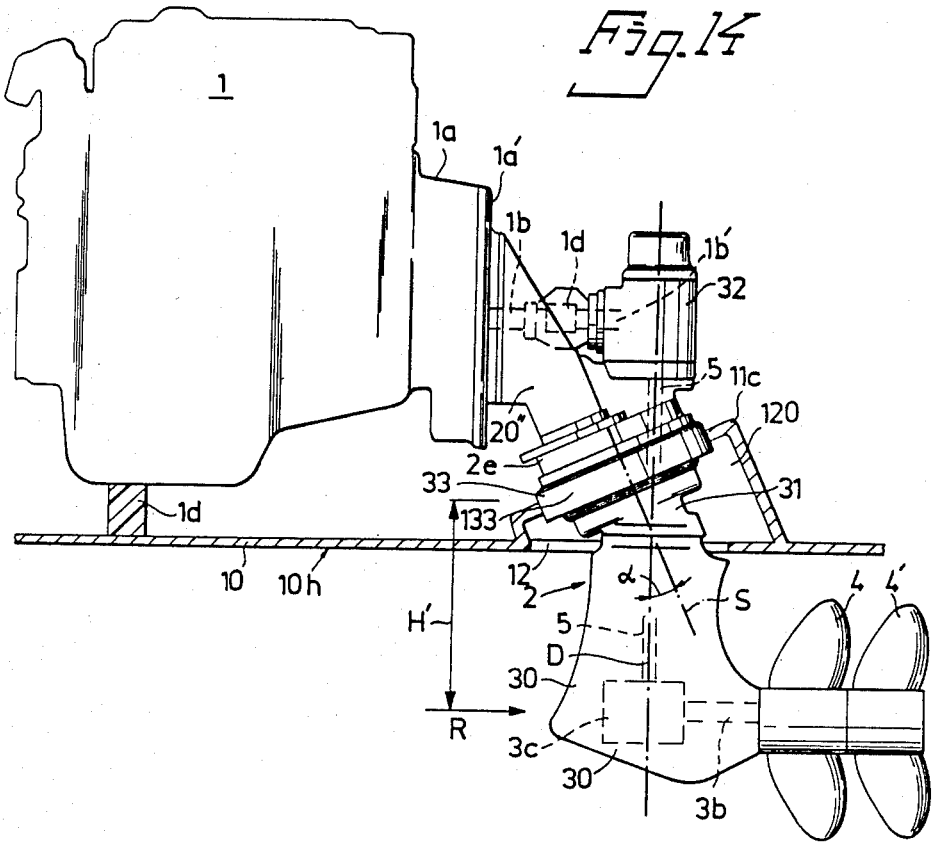
FIG. 14 is a schematic side view of a further embodiment.

In the modification FIG. 14 engine part 1 is mounted near the forward end on a pair of damper blocks 1*d* and has at the rear end flywheel housing 1*a* with cap 1*a'* from which engine output shaft 1*b* projects. The support bracket 20'' has a partial tubular shape with a front vertical portion secured to flywheel cap 1*a'* and slopes angularly downward and rearward and rests with its lower end secured on a socket part 2*e* which is mounted on a support 33. The propeller leg 2 has upper module 32, an intermediate module 31 and a lower or propeller module 30 with propeller housing 3 secured together as a unit. The engine shaft 1*b* is connected by a universal joint 1*d* to stub shaft 1*b'* and upper gear box 1*c* in housing 1*c'* of upper module 32 which drives vertical power transmission shaft 5. The shaft 5 drives lower gear box 3*c*. horizontal propeller shaft means 3*b* and one or dual propellers 4, 4'. The propeller leg 2 is fixedly and rotatably supported by bearing 133 having an inner bearing part on intermediate module 31 and an outer bearing part on socket part 2*e*. The socket part 2*e* on which bracket 20'' and bearing 133 rest is mounted and sealed on an annular resilient vibration damping member 40 as shown in FIG. 11 which is mounted and sealed in an annular bedding 11C provided in the bottom 10 of hull. Thus socket part 2*e* and damping member 40 provide support 33 supporting through bracket 20'' the rear end of engine part 1 and propeller leg 2 resiliently on hull 10*h*. The pivotal axis of bearing 133 and thus the side steering axis S is inclined forwardly at an acute angle $\alpha$ with the axis D of power transmission shaft 5.

Figure 15:
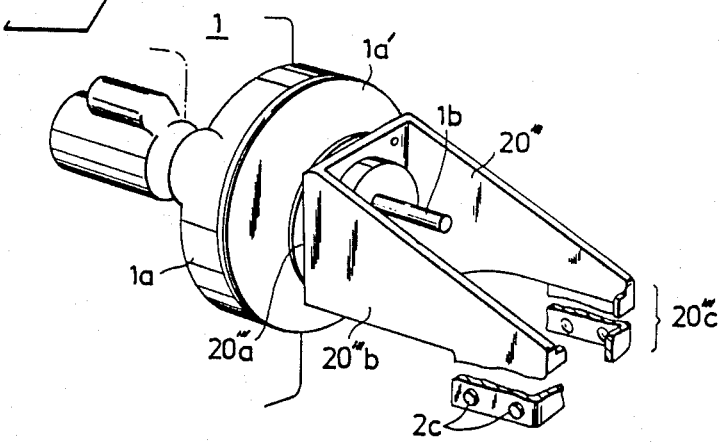
FIG. 15 is a partial perspective view of a modified bracket.

Another embodiment of a support bracket 20''' is shown in FIG. 15 and similarly fixed to cap 1*a'* of flywheel housing 1*a* of engine 1. Support bracket 20''' like the other support brackets projects from cap 1*a'* toward the rear like engine output shaft 1*b*, and has, like bracket 20'' in FIG. 14, a vertical portion 20'''*a* attached to cap 1*a'*, a rearwardly extending portion 20'''*b* and a downwardly extending portion 20'''*c*, rather than the rearwardly and downwardly sloping portion of bracket 20'' FIG. 14. The bottom of the downwardly extending portion 20'''*c* is secured by screws 2*c* to propeller leg 2 (lower housing) directly or through a socket part 2*e*.

Figure 13:
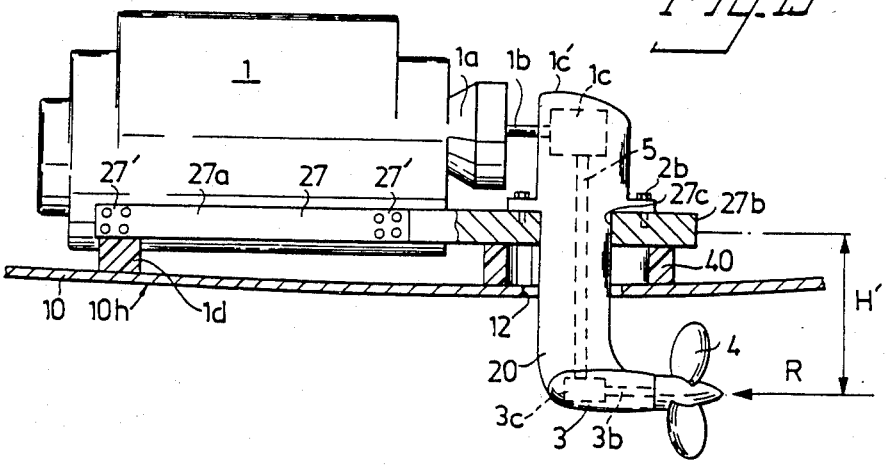
FIG. 13 is a schematic side view with parts in section of another embodiment with a support bracket.

The arrangement according to the invention is used in drives having one propeller, FIGS. 12 and 13, or dual propellers, FIG. 14, or propellers of the pusher type FIG. 10, or of the traction type, FIG. 9. The support bracket may protrude with respect to the engine part in a rearward or aft direction or in the reverse direction, i.e. forward in the direction of driving M, FIGS. 7, 8, 9, 10, if such location of engine part 1 and propeller leg 2 is desired.

The support bracket is fixed to the propeller leg 2 between the engine output shaft 1*b* and propeller shaft 3*b*, essentially centrally between these shafts, i.e. below the output shaft 1*b* and upper gear box 1*c*, and preferably at the bottom of engine part 1 near the bottom 10 of hull 10*h*. The first resilient means for supporting engine part 1, and the second resilient means for supporting the bracket and the attachment of propeller leg 2 to the bracket are substantially in horizontal alignment. Thus the lever arm H', FIGS. 12, 13 and 14, of the bending moment generated by propeller thrust R has a reduced value as compared to the lever arm H FIG. 1 of a prior art drive otherwise having similar dimension values. Since the bending moment is the product of the lever arm and thrust ($M=H\times R$), the bending moment ($H'\times R$) is reduced. Thus the stress on the attachment of the propeller leg to the engine part is also reduced and the vibration forces are reduced, and more easily damped by the large unitary mass of the engine and propeller leg mounted on damper means nearby aligned with the place of attachment. This improved construction with a reduced lever arm is obtained without direct contact of the propeller leg to the hull at opening 12 which would directly transmit vibration and noise to the hull 10.

Figure 16:
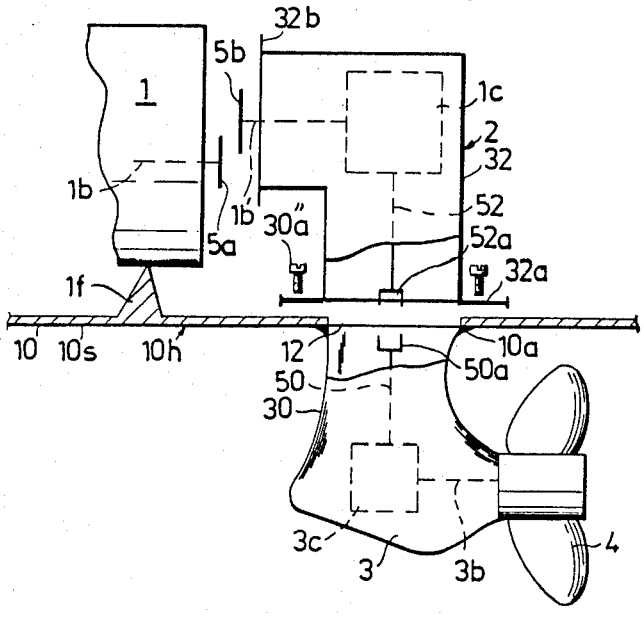
FIGS. 16, 17 and 18 are schematic partial side views with parts in section and in disassembled condition respectively of first, second and third principal embodiments of a modular housing arrangement.
Figure 17:
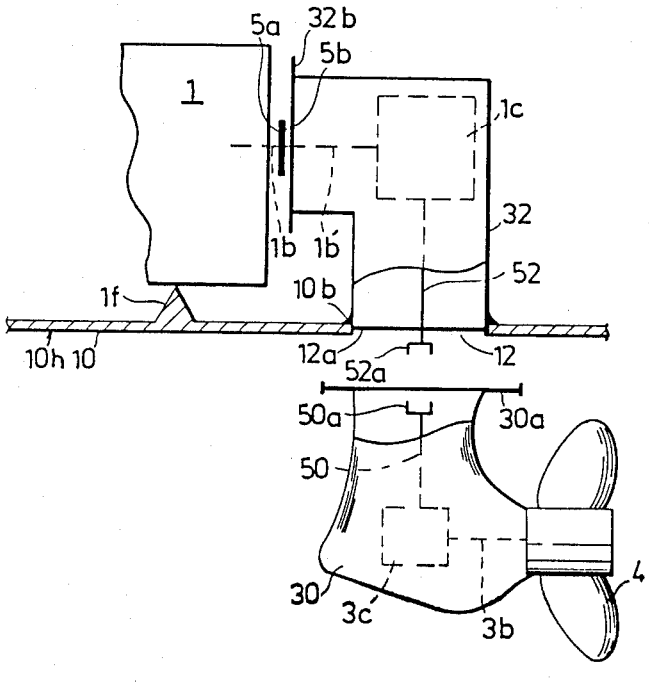
Figure 18:
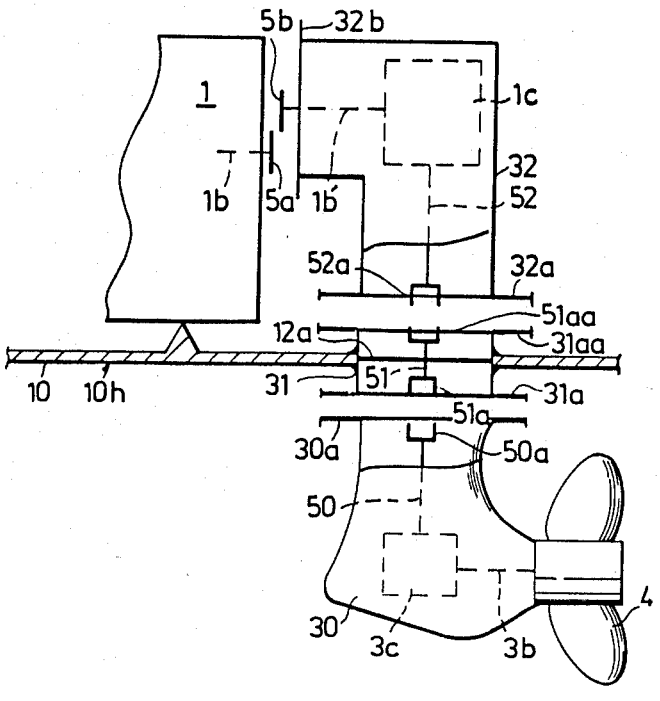

FIGS. 16 to 18 schematically show three different embodiments of a modular housing arrangement, each making use of some principles of the present invention.

In FIG. 16 the propeller leg assembly 2 comprises an outboard module 30 which has a propeller housing part 3 with power transmission drive means mounted therein and including the power transmission shaft 50, the lower angular gear box 3C, which is a 90° angular gear, and propeller shaft 3*b* for supporting and driving propeller 4. The outboard module 30 provides a watertight enclosure with an open upper end which receives shaft 50 and is aligned with opening 12 and is attached and sealed by attaching means 10*a*, e.g. by welding etc. not shown in detail, around opening 12 to bottom 10 of hull 10*h*. An inboard module 32 has power transmission means including the upper angular (90°) gear box 1*c*, drive or power transmission shaft 52 and stub shaft 1*b'* connected by connectional coupling 5*a*, 5*b* to engine shaft 1*b*. Inboard module 32 has an open lower end positioned over opening 12 in bottom 10 and a lower connecting flange 32*a* which is attached and around opening 12 to bottom 10 by retaining screws 30*a''*. The inboard module 32 also has an upper or another connecting flange 32*b* at the upper end for similarly securing inboard module 30 to engine part 1.

Figure 19:
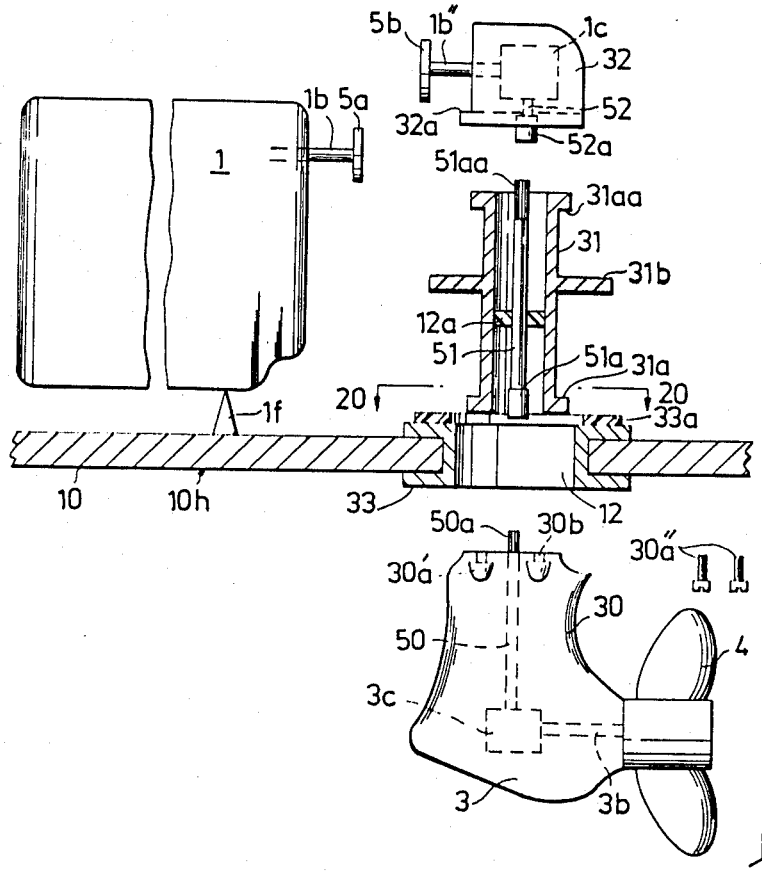
FIG. 19 is a schematic side view with parts in section and in disassembled condition of a modification of FIG. 18.
Figure 20:
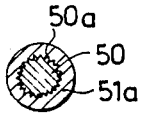
FIG. 20 is an enlarged cross-sectional view on the line 20—20 of coupling 51*a* and shaft 50 of FIG. 19.

The respective outboard and inboard modules 30 and 32 each has its shaft portion respectively 50 and 52 having at their adjacent free ends its coupling part 50*a* and 52*a* of a detachable coupling 50*a*, 52*a*. Upper gear box 1*c* drives shaft portion 52, coupling 50*a*, 52*a* and shaft portion 50 providing detachable power transmission shaft means which extends through inboard module 32, its open lower end, opening 12 and open upper end of outboard module 30 and in outboard module 30 to drive gear box 3*c*, shaft 3*b* and propeller 4. In practice these parts of a coupling will be defined by a spline joint with outward grooves, e.g. 50*a* on the shaft portions, e.g. 50, and inward grooves in a connecting sleeve, e.g. 51*a* which is slidable on the shaft portions, as shown in FIGS. 19 and 20. Stub shaft 1*b'* and conventional coupling 5*a*, 5*b* are provided for detachably drive-connecting output shaft 1*b* of engine part 1 to upper angular gear box 1*c*. It will be recognized that both inboard and outboard modules 30, 32 function together as a propeller leg assembly 2 and that for repair or replacement of the inboard module 32 it may be removed by detaching lower and upper connecting flanges 32*a* and 32*b*, coupling 50*a*, 50*b* and coupling 5*a*, 5*b* without causing any leakage through opening 12 into hull 10*h* and without need for an extra sealing element or membrane in opening 12, since the outboard module 30 continues to seal opening 12.

In the following descriptions of various embodiments and modifications of the invention the modified structure is described and reference is made to the prior description of similar parts in other embodiments or modifications.

In the embodiment of FIG. 17, the inboard module 32 is attached by attaching means 10*b* to the bottom 10 of the hull 10*h* and the outboard module 30 is provided with a connection flange 30*a* secured by retaining screws (not shown for clarity). In the opening 12 is a sealing membrane 12*a* sealed to bottom 10 and through which sealingly passes the shaft portion 52 whose coupling element 52 is located on the outboard side of the membrane 12*a* for connection with the coupling element 50*a* on shaft portion 50.

In the preferred embodiment of FIG. 18, a third module unit, an intermediate module 31, is fixedly mounted to the bottom 10 of the hull 10*h*. The intermediate module 31 is on the one hand provided with a lower connection flange 31*a* for attachment to the connection flange 30*a* of the outboard module 30, and on the other hand with an upper connection flange 31*aa* for attachment to the lower connection flange 32*a* of the inboard module 32. In the intermediate module 32 is a sealing membrane 12*a* and a transmission shaft portion 51. The shaft portion 51 passes sealingly through the membrane 12*a* and is at both ends provided with a coupling part 51*a*, 51*aa* for connection to corresponding coupling parts 50*a* and 52*a* on the shaft portions 50 and 52. Inboard module 32 is as shown in FIG. 16, and outboard module 30 is as shown in FIG. 17 and described above.

In this preferred embodiment FIG. 18, the boat remains sealed irrespective of which of the modules 30 and 32 is removed, and it is easy to dismount as well from beneath (i.e. from the outboard side) the outboard module 30 from the intermediate module 31, as from above (i.e. from the inboard side) the inboard module 32 from the intermediate module 31, if the one or the other is needed, e.g. for repair modification purposes.

Figure 21:
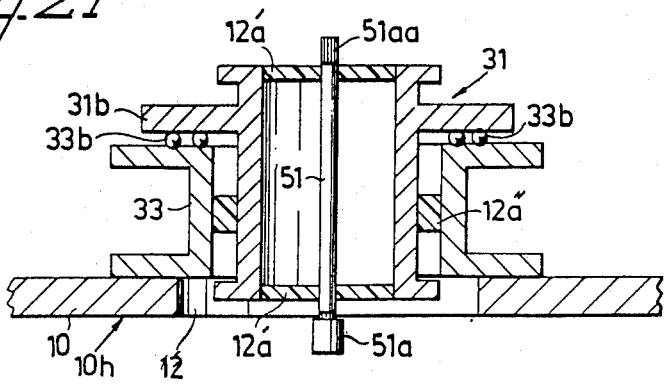
FIG. 21 is an enlarged axial cross-sectional view of a modification of the intermediate module 31 in the embodiments of FIGS. 18, 19 and 23.

In FIGS. 19 and 21 is shown a further embodiment where the intermediate module 31 is mounted in a support 33 which in its turn is fixedly mounted in opening 12 in bottom 10 of hull 10*h*. The intermediate module 31 has a flat collar 31*b* with which it will rest on a sealing packing 33*a*, e.g. of rubber, on the support 33. Inside the intermediate module 31, the shaft portion 51 passes sealingly through said sealing packing 12*a*. The outboard module 30 is instead of a connection flange, provided with separate recesses 30*a*′ adjacent openings 30*b* through which retaining screws 30″ pass towards threaded holes (not shown) in the connection flange 31*a* of intermediate module 31. Inboard module 32 has flange 32*a* secured by screws to flange 31*aa* of intermediate module 31 as in FIG. 18.

In FIG. 20 coupling parts 50*a* and 51*a* are shown. They are defined by outer splines 50*a* on shaft 50 and by sleeves 51*a* having inner splines fixed to the respective shaft portion 51. The other coupling parts 51*aa* and 52*a* are similar. As is well known, a spline joint may be readily assembled by axially inserting one part into the other, and moreover has a telescopic effect, i.e. it allows to some extent axial movement even under operation.

The intermediate module 31 of FIG. 21 may even be rotatably mounted in its support, e.g. with the aid of rolling or ball bearings 33*b* whereby a side-steerable inboard outboard drive as e.g. in FIG. 12 is obtained. The shaft portion 51 is sealed by two packings 12*a*′ and the intermediate module is sealed in regard of its support 33 by a further packing 12*a*″.

In FIG. 2 has already been shown another embodiment of of a propeller leg or lower unit built up of three module units, where the engine part 1 is provided with a flywheel housing 1*a* and on the bottom 10 of the hull 10*h* is a pivotal bearing 133, shown on a larger scale in FIG. 5, mounted in an inclined position. Propeller leg 2, composed of the module units 30, 31 and 32, is pivotally mounted in the pivotal bearing 133 for rotating about steer axis G.

The intermediate module 31 has conical outer envelope surface which fits into and is supported on the pivotal bearing 133 and the axis of which coincides with, or more precisely, defines, the side-steering axis G. The intermediate module 31 is at K, i.e. at the narrowest place of the conical surface, attached to the outboard module 30, whereby insertion of the lower unit into the conical pivotal bearing 133 is enabled. The conical envelope surface defines a receiving surface for the lower unit and it can be arranged on a separate part around the module, as has been shown in FIGS. 5 and 6, instead of being provided immediately on the module itself.

In another three module embodiment according to FIG. 4, straight console or bracket 27 is attached to the engine part 1 and the pivotal bearing 133 is mounted on the bracket. The opening 12 in the bottom 10 of hull 10*h* is sealed by the membrane 12*a* and is inboard surrounded by an annular resilient means 40 which supports the rear terminal portion of bracket 27 where the bearing 133 for the propeller leg assembly 2 is mounted.

Figure 22:
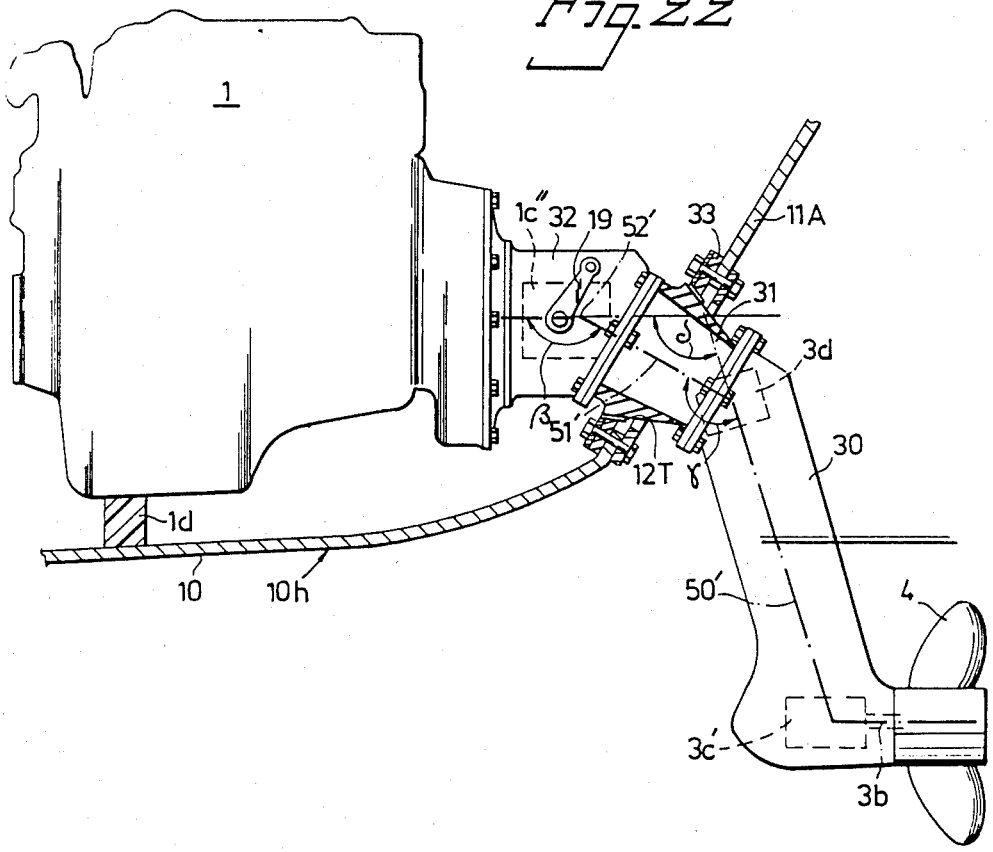
FIG. 22 is a diagramatic side view with parts in section of an inboard outboard drive according to the invention with a not exactly vertically extending lower unit.

The propeller leg assembly or lower unit 2 composed of the modules 30 and 32, or 30, 31 and 32 need not necessarily extend exactly vertically. In FIG. 22 is shown an inclined transom 11A attached to bottom 10 of hull 10*h*, having adjacent bottom 10 an opening 12T in which support 33 is mounted. The intermediate module 31 passes with its axis, defined by shaft 51′, essentially at right angles through transom 11A and modules 30 and 32 are attached to intermediate module 31 with their axes, defined by shafts 50′ and 52′, subtending angles $\beta$ and $\gamma$, which are other than 90° and 180°, with shaft 51′. In the example shown, $\beta$ is appr. 150°, and $\gamma$ is appr. 135°, so that shafts 50′ and 52′ subtend together an angle $\delta$, appr. 105° which is not too different from 90° as shown in the other exemplary embodiments. The outboard module 30 has in addition to lower angular gear box 3*c*′, another intermediate angular gear box 3*d*, and both these angular gear boxes, as well as the upper angular gear box 1*c*′ arranged in the inboard module 32, differ from the angular gear boxes described hitherto in that they are more than 90° angular gear boxes. Inboard module 32 carries a gear lever 19 for gear box 1*c*.

Figure 23:
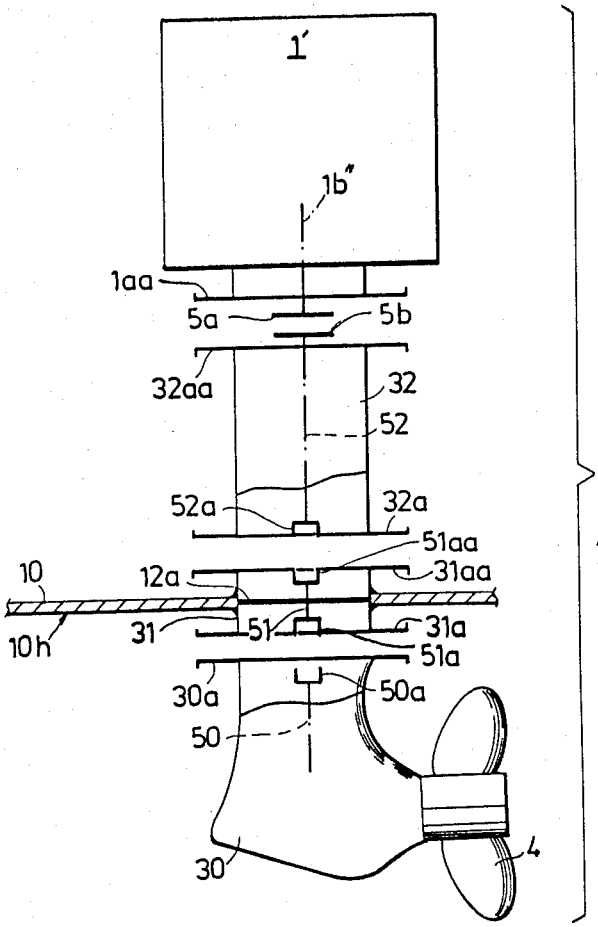
FIG. 23 is a diagramatic side view with parts in section and in disassembled condition of a modification of the drive of FIG. 18.

An inboard outboard drive may even have, as stated earlier, an engine part with a vertical output shaft. In FIG. 23 is shown such a solution in connection with the present invention. The inboard module is there provided with a second connection flange 32*aa* to which an engine part 1′ with a vertical output shaft 1*b*″ is attached with the aid of a corresponding connection flange 1*aa*. Otherwise this drive is like FIG. 18.

Figure 24:
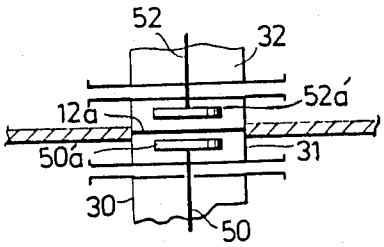
FIG. 24 is a diagramatic partial sectional view of a modified drive employing a magnetic coupling for the transmission of torque between separate portions of the shaft.

The coupling parts which connect the shaft portions of the separate modules may according to FIG. 24 also be defined by parts 50*a*′ and 52*a*′ of a magnetic coupling, which are separated by a sealing membrane 12*a* of non-magnetic material. It will be observed that in this case the intermediate module 31 does not need to have any shaft portion of its own, but merely a membrane 12*a*.

Figure 25:
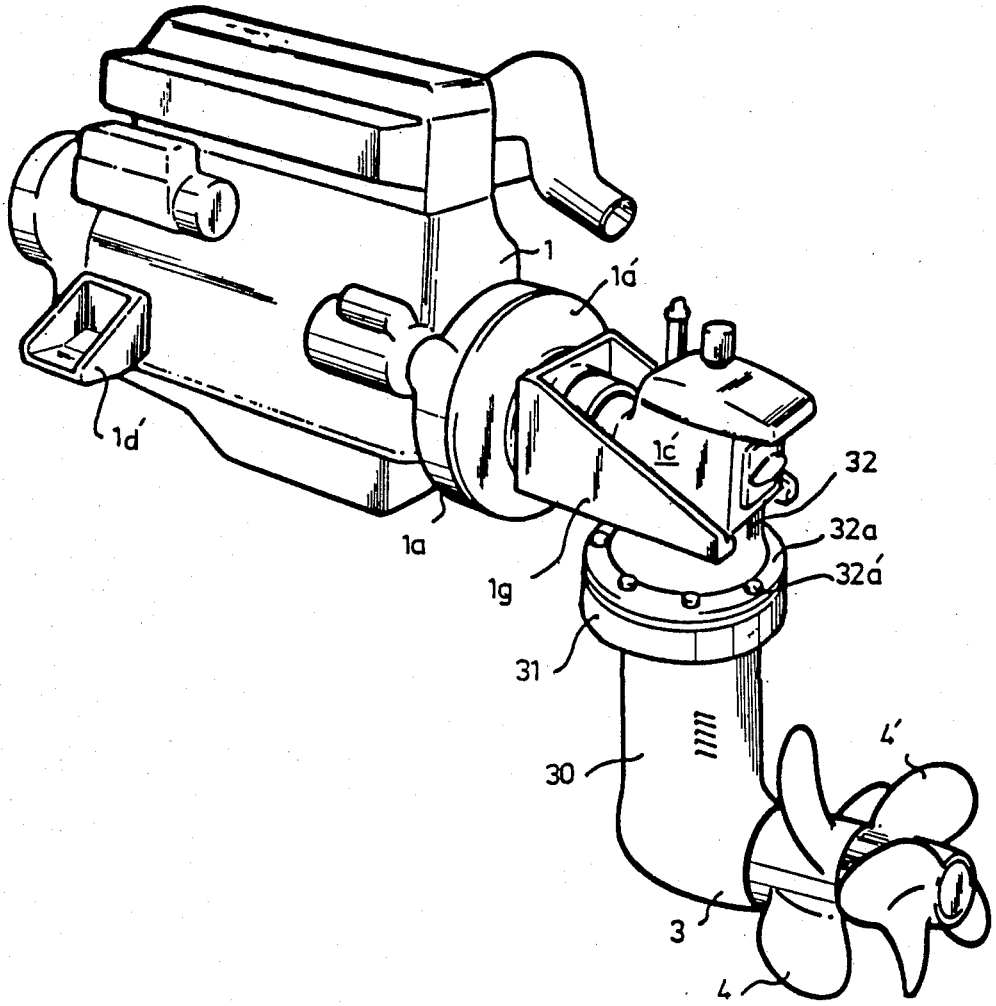
FIG. 25 is a perspective view of a modified inboard outboard drive according to the invention.

FIG. 25 shows in perspective an inboard outboard drive according to the invention, assembled outside a boat hull. The engine part 1 is provided with holders 1*d'* to be fixed to rests 1*d* (FIG. 1) and with a fork-shaped guide 1*g* attached to the cap 1*a'* of the flywheel housing 1*a* and from which the housing 1*c'* of the angular gear box of the inboard module 32 protrudes. The connection flange 32*a* of inboard module 32 is attached by screws 32*a'* to the intermediate module 31. Intermediate module 31 may rest on an annular resilient means 40 of FIG. 12 and guide 1*g* may at the same time fill the function of rods 20' and bracket 20.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

With reference to FIG. 22 it will be noted that a propeller leg extends essentially vertically in the sense of the present specification if at least the outboard portion thereof subtends an angle of 90°–120° with a horizontal part, such as a horizontal output shaft, of the drive.

What is claimed as new and what is desired to secure by Letters Patent is:

1. An inboard outboard drive for use in a boat having an inboard located engine part and an opening in the bottom shell of the boat hull comprising a propeller leg assembly having an upper inboard housing portion and a lower outboard housing portion and extending essentially vertically through the opening, upper angular gear means mounted in said upper housing portion, output shaft means of said engine part having an inboard mounted universal joint and extending essentially horizontally for drive connecting the engine part to said upper angular gear means, lower angular gear means mounted in said lower outboard housing portion, propelling means mounted on said lower outboard housing portion for propelling the boat, power transmission means including a power transmission shaft extending essentially vertically in said propeller leg assembly for drive connecting said upper angular gear means to said lower angular gear means, and propeller shaft means extending from said lower angular gear means and projecting horizontally out of one end of said lower outboard housing portion and carrying said propeller means, and bearing means mounted inboard the hull over said opening for pivotally mounting said propeller leg assembly in the opening for steering pivotal movement about the axis of said bearing means defining side steering axis which is inclined at an acute angle to said power transmission shaft, forwardly at its upper end and passes through said universal joint.

2. The invention defined in claim 1 further comprising support bracket means fixedly attached to the engine part and whereto said bearing means is fixedly mounted.

3. The invention defined in claim 1 wherein said bearing means is fixedly attached to the bottom shell of the boat hull.

4. The invention defined in claim 1 further comprising cooling water intake pipe means mounted in said propeller leg assembly and having an orifice portion on the forward outboard edge of said propeller leg assembly for receiving water for cooling and an end portion receiving water from said orifice portion and extending concentrically with said side steering axis.

5. The invention defined in claim 1 wherein said bearing means comprises a concave conic bearing bed surface tapering downwardly from the outer diameter to the inner diameter and which is constructed for attachment in an inclined position axially aligned with said side steering axis, and a corresponding convex conic receiving surface tapering downwardly on said propeller leg assembly and supported on said concave conic bearing bed surface to support said propeller leg assembly for pivotal movement about said side steering axis and sealing and bearing means provided between said concave bearing bed surface and convex receiving surface.

6. The invention defined in claim 5 wherein said propeller leg assembly comprises a first module means which has said convex conic receiving surface at the lower end for seating said conic receiving surface from above in said concave conic bearing bed surface, and a lower outboard module for attaching from underneath to said first module means and defining said lower outboard housing portion.

7. The invention defined in claim 6 wherein said first module means comprises an upper inboard module providing said upper inboard housing portion and an intermediate module connected at its upper end to said upper inboard module and provided with said convex conic receiving surface.

8. The invention defined in claim 6 further comprising cooling water intake pipe means having an orifice at the outboard fore edge of said lower outboard module said orifice being provided by a grill having at least one slot extending transversely relative to said side steering axis, and cleaning comb means fixed on the hull and having at least one comb tooth located on the outside of the bottom of the hull and fitting in said slot so that in response to side steering movement of said propeller leg assembly said slot moves over said comb tooth to automatically be scraped and cleaned by said comb tooth.

9. The invention defined in claim 6 wherein said lower outboard module in its upper portion for attachment to said first module is symmetrical relative to said power transmission shaft to provide for selective attachment of said one end from which the propeller shaft means projects located aft or forward.

10. The invention defined in claim 9 wherein said cooling water intake pipe means has two symmetrically located orifices located at the fore and aft edges of said lower outboard module, said grill being attached to said lower outboard module over said orifice at the fore edge for cooperating with said cleaning comb means and closure means being attached to said lower outboard module to provide a closure for the other orifice at the aft edge.

11. The invention defined in claim 10 wherein said closure means are defined by a stabilizer fin extending longitudinally aft.

12. The invention defined by claim 5 wherein said conic receiving surface is defined by a conically shaped envelope surface on said propeller leg assembly.

13. An inboard outboard drive for use in a boat having an inboard located engine part with output shaft means and an opening in the bottom shell of the boat hull, comprising a propeller leg assembly extending essentially vertically through the opening, propelling means mounted on the lower portion of said assembly for propelling the boat, and bearing means for pivotally mounting said propeller leg assembly in the opening for side steering pivotal movement on a side steering axis, further comprising cooling water intake pipe means having an orifice at the outboard fore edge of said lower portion, said orifice being provided by a grill having at least one slot extending transversely relative to said side steering axis and a cleaning comb means fixed on the hull and having at least one comb tooth located on the outside of the bottom of the hull and fitting in said slot so that in response to side steering movement of said propeller leg assembly said slot moves over said comb tooth to automatically scrape and clean said slot.

14. An inboard outboard drive for use in a boat having a hull with an opening in the bottom, comprising an engine part having an engine output shaft protruding horizontally from one end of said engine, a propeller leg extending downwardly from said output shaft closely adjacent said one end of said engine and extending through said opening and having a propeller housing portion at the outboard located bottom end, propelling means on said propeller housing providing horizontal propeller thrust, drive means drive-connecting said engine output shaft downwardly through said propeller leg to drive said propelling means, support bracket means fixedly attached to said engine part and having a protruding portion protruding from said one end of said engine part and fixedly attached to said propeller leg at a place on said propeller leg located spacedly below said output shaft to unite said engine, propeller leg, drive means and propelling means into a unitary inertial mass subject to vibration, resilient vibration damping support means for mounting in the hull having a first vibration damping support engaging said engine part and a second vibration damping support supporting the propeller leg and bracket means in the region of the protruding portion, and sealing means providing a watertight seal between the propeller leg and the hull.

15. The invention defined in claim 14 wherein said second vibration damping support is annular and seals the space between the hull and said protruding portion of said support bracket means around said propeller leg and the opening.

16. The invention defined in claim 15 wherein said propeller leg is non-rotatably attached to said support bracket means.

17. The invention defined in claim 14 wherein said propelling means is a screw propeller, said drive means has an upper angular gear box aligned with and driven by said engine part output shaft, a lower angular gear box in said propeller housing, a power transmission shaft driven by said upper gear box and extending vertically down through said propeller leg to drive said lower angular gear box, and a horizontal propeller shaft driven by said lower gear box and driving said propeller, said protruding portion of said support bracket means being located around and attached to said propeller leg at a place spaced below said output shaft and upper angular gear box, centrally between said output shaft and propeller shaft and horizontally in the region of said resilient vibration damping support means, and said first vibration damping support having portions laterally spaced on opposite sides of the engine part and said second vibration damping support being an annular member located between said protruding portion of the support bracket means and the hull.

18. The invention defined in claim 14 wherein said support bracket means is partially tubular.

19. An inboard outboard drive for use in a boat having an inboard located engine part and an opening in the shell of the hull; comprising a propeller leg assembly extending essentially vertically downwardly from the engine part through said opening to drive a propeller means, said propeller leg assembly having an inboard module for locating inboard a hull and which has an upper terminal portion for attachment to said engine part; an outboard module having a propeller housing portion for mounting outboard of the hull and a propeller means rotatably mounted on said propeller housing portion; power transmission shaft means in said inboard and outboard modules extending downwardly through said opening hull for transmitting torque from said engine part to said propeller means and having inboard shaft means mounted in said inboard module for drive-connecting to an engine, outboard shaft means including a lower angular gear box mounted in said outboard module and drive-connected to said propeller means, and readily detachable coupling means for drive-connecting said inboard and outboard shaft means when said inboard and outboard modules are assembled to form said propeller leg assembly, and for disconnecting said inboard and outboard shaft means when said inboard and outboard modules are disassembled, and attachment means for attaching said inboard and outboard modules to each other and to the hull around said opening to form and make watertight said propeller leg assembly and seal said opening in the hull for drive operation and for detaching one of said inboard and outboard modules for repair or replacement and the other of said inboard and outboard modules remaining attached to the hull and sealing said opening to prevent the entry of water into the hull.

20. The invention defined in claim 19 wherein said attachment means has outboard attachment means for affixing and sealing said outboard module to the hull around the opening and has inboard attachment means for detachably securing said inboard module to the hull around the opening.

21. The invention defined in claim 19 wherein said attachment means has inboard attachment means for affixing said inboard module to the hull around the opening and has outboard attachment means for detachably securing and sealing said outboard module to the hull around the opening and a membrane sealing the opening around said inboard shaft means.

22. The invention defined in claim 19 wherein said attachment means has an intermediate module of tubular shape for securing and sealing to the hull in the opening, inboard attachment means detachably securing said intermediate module to said inboard module and outboard attachment means detachably securing and sealing said intermediate module to said outboard module, a sealing membrane in said intermediate module and said transmission shaft means having means for transmitting torque through said sealing membrane and connected by said coupling means to said inboard shaft means and to said outboard shaft means.

23. The invention defined in claim 22 wherein said means for transmitting torque has intermediate shaft means which sealingly passes through said sealing membrane and said coupling means has inboard and outboard coupling means respectively detachably drive-connected to said inboard and outboard shaft means.

24. The invention defined in claim 23 wherein said inboard and outboard coupling means each are a mechanical coupling having a splined joint.

25. The invention defined in claim 23 wherein said inboard and outboard attachment means each are a flange respectively on the inboard and outboard module and a flange on the adjacent end of said intermediate module and a retaining screws fastening.

26. The invention defined in claim 22 wherein said means for transmitting torque through said sealing membrane is a magnetic coupling.

27. The invention defined in claim 22 and further comprising side steering means including a steering bearing for mounting inboard the hull over said opening and one of said modules being pivotally mounted in said steering bearing and secured in a non-rotary manner to the other modules for bodily rotation of said propeller leg assembly in said steering bearing.

28. The invention defined in claim 19 wherein said opening is provided in an inclined transom adjacently the bottom of the hull and the outboard module is provided with an intermediate angular gear box, and all angular gear boxes in all modules are more than 90° angular gear boxes.

* * * * *